US008245445B2

(12) United States Patent
Palacios

(10) Patent No.: US 8,245,445 B2
(45) Date of Patent: Aug. 21, 2012

(54) SASH WINDOW

(76) Inventor: Enrique Lago Palacios, Pontevedra (ES)

( * ) Notice: Subject to any disclaimer, the term of this patent is extended or adjusted under 35 U.S.C. 154(b) by 110 days.

(21) Appl. No.: 12/452,719

(22) PCT Filed: Jul. 17, 2008

(86) PCT No.: PCT/ES2008/070141

§ 371 (c)(1),
(2), (4) Date: Jan. 19, 2010

(87) PCT Pub. No.: WO2009/022045

PCT Pub. Date: Feb. 19, 2009

(65) Prior Publication Data

US 2010/0115845 A1 May 13, 2010

(30) Foreign Application Priority Data

Jul. 27, 2007 (ES) ..... 200702113

(51) Int. Cl.
*E05D 15/20* (2006.01)

(52) U.S. Cl. ..... 49/128; 49/127

(58) Field of Classification Search ..... 49/127, 49/128, 129, 213
See application file for complete search history.

(56) References Cited

U.S. PATENT DOCUMENTS

| | | | | | |
|---|---|---|---|---|---|
| 1,533,048 | A | * | 4/1925 | Sustarsic et al. | 49/129 |
| 1,636,806 | A | * | 7/1927 | Campbell | 49/128 |
| 1,854,419 | A | * | 4/1932 | Neuhausen | 49/129 |
| 1,922,370 | A | | 8/1933 | Johnson et al. | |
| 1,942,239 | A | * | 1/1934 | Chauvet | 49/127 |
| 2,601,706 | A | * | 7/1952 | Orlin | 49/127 |
| 2,908,052 | A | * | 10/1959 | Jakush | 49/129 |
| 4,551,945 | A | * | 11/1985 | von Resch | 49/221 |
| 4,802,307 | A | * | 2/1989 | Schmidt | 49/219 |
| 5,189,837 | A | * | 3/1993 | Ienaga | 49/130 |
| 6,336,246 | B1 | * | 1/2002 | Giovannetti | 16/87 R |
| 6,581,331 | B1 | * | 6/2003 | Kral | 49/339 |
| 6,840,009 | B2 | * | 1/2005 | Ronay et al. | 49/127 |
| 2003/0150165 | A1 | * | 8/2003 | Ronay et al. | 49/127 |

FOREIGN PATENT DOCUMENTS

| | | | |
|---|---|---|---|
| DE | 27 24 149 | A1 | 12/1978 |
| DE | 42 25 328 | A1 | 2/1994 |
| EP | 1 710 379 | A1 | 10/2006 |
| ES | 150519 | | 7/1970 |
| FR | 2 514 398 | A1 | 4/1983 |
| WO | WO 92/12321 | A1 | 7/1992 |

* cited by examiner

*Primary Examiner* — Katherine W Mitchell
*Assistant Examiner* — Justin Rephann
(74) *Attorney, Agent, or Firm* — Breiner & Breiner, L.L.C.

(57) ABSTRACT

The invention relates to an improved sash window including a window frame (1) containing two sashes (2 and 3) which are disposed in the same first vertical plane in the closed window position. The lower sash (3) is connected to a counterweight mechanism (8) enabling same to move vertically in the window frame (1). The window also includes scissor mechanisms (9) which are guided between the jambs (4) of the window frame (1) in order to move the lower sash (3) horizontally forward from the first vertical plane in which the window is closed to a second vertical plane in which the window is open or vice versa. The lower sash is maintained in the open position by means of blocking elements (24, 25) and is moved vertically with the aid of the counterweight mechanism (8).

3 Claims, 4 Drawing Sheets

SASH WINDOW

FIELD OF THE INVENTION

The present invention relates to an improved sash window including a window frame containing two window sashes disposed in the same vertical plane in the closed window position, with the lower sash being also connected by cables to a counterweight vertical-movement mechanism enabling same to move in the window frame, maintained in a second vertical plane, until occupying, for example, a position parallel to the upper sash in an open window position.

Its field of application is intended to be in sash window manufacturing in order to provide the sealing in the sliding of the sash on the frame, given that there is not enough pressure between both, especially in sash windows of recent design; nevertheless, its field of application is also considered to be in the manufacture of any European standard series sash windows existing on the market, with only one requirement: adaptation of a profile for the lower window sash.

BACKGROUND OF THE INVENTION

Ever since Spanish Patent ES 150519, for example, a counterweight sash window has been known, which window incorporates a mechanism comprising cables, pulleys and weights, intended to assist the vertical movement of the sashes. In the closed position, the window sashes are arranged one after the other, forming a single vertical plane; nevertheless both sashes are guided, the inner sash in lateral guides in the casing that drive its vertical and horizontal path to the outside, and the outer sash in lateral guides that drive it in its vertical path. The horizontal movement of the inner sash to the outside situates the sash in the same vertical plane as that occupied by the outer sash, thus permitting the setting and adjustment of the ruled surfaces of the bottom edge of the outer sash over the top edge of the inner sash. The invention describes the presence of joint covers and weather stripping that clearly do not guarantee the sealing of the window.

A counterweight vertical-movement mechanism that includes a counterbalanced spring for counterweighting suspended elements has been already disclosed in U.S. Pat. No. 1,922,370, which describes a rotatable supported shaft over a support, a pair of opposing pulleys secured to the shaft in such a way that they rotate together with said shaft, a pair of support cords, one end of which is secured to the suspended element while the other end is secured to the respective pulley, in which each of the pulleys includes a circular groove in which the respective cords can be wound in order to move the suspended element, and in which said shaft is connected by one end to an elastic element whose opposite end is secured to a friction disc. The use of this mechanism facilitates the movements initiated by the user to vertically move the suspended element, as said movements are counterweighted at any point of the movements.

OBJECT OF THE INVENTION

According to the above background, the object of the present invention is to provide an improved and simplified sash window, which is outfitted with projection means that move horizontally and frontally one of the window sashes to a separate position of the frame where it is maintained in order to run a vertical path aided, together with the user, by a counterweight vertical-movement mechanism. This permits, for example, the placing of sealing gaskets in the front of the window frame and in the inner perimeter of the window casing. Additionally, the object of the invention extends to conventional sash windows that are already installed.

SUMMARY OF THE INVENTION

The present invention provides an improved sash window that aims at a better sealing of the window and a smoother vertical movement of the sliding sashes in the window frame.

In general, to accomplish the proposed object, there is provided an improved sash window of the type that includes a window frame and two window sashes arranged in the frame so as to occupy the same first vertical plane in the closed window position, with the lower sash connected by cords or cables to a counterweight vertical-movement mechanism that includes a counter-balanced spring or torsion spring for aiding the counterweighted movement of said lower sash vertically in the window frame, and so that said lower sash is parallel to the upper sash in an open window position.

The main feature of the invention is to provide the frontal movement of the lower window sash from a first vertical plane in the closed window position to a second plane in an open window position, or vice versa, thus projecting it in a continuous horizontal path between both the first and the second vertical planes and forced to be separated from the first vertical plane with the help of blocking elements so as to be ultimately moved in a vertical path aided by the counterweight vertical-movement mechanism.

Advantageously, in order to avoid imbalances during said movement, the frontal and horizontal movement of the lower window sash is performed with the help of projection means formed by two scissor mechanisms that are guided between the side jambs of the window frame and whose arrangement in the window ensures a single degree of freedom in the horizontal direction for the lower sash, for which purpose the lower ends of each scissor arm are fixed in the closed window position while the upper ends are guided during sash movements. Each scissor mechanism includes two arms formed by hinged strips, and both arms are articulated to each other. As mounted in the window, the first arm of each mechanism is articulated at its lower end to a square anchor arranged, respectively, in the proximity of the closest bottom corner of the lower window sash and is articulated at its upper end to a strip anchor that is guided in the respective stile of the lower window sash; the upper end of the second arm incorporates a pin that, after traversing the outer face of the nearby stile, is secured to an inner rod sliding in a guide rod that is joined to the immediate jamb of the window frame, while its lower end is secured to the end of a torsion bar formed by a hollow tube that maintains the distance between the scissor mechanisms and to whose ends both terminals have been axially coupled, secured to the tube by elastic pins, and whose free ends are connected to sliders that guide the lower window sash in its vertical movements. The torsion bar locks together the movements of the scissor mechanisms situated to the right and left between the stiles of the lower window sash to be projected and the nearby jambs of the window frame, thus maintaining the parallelism of the window in the open position.

Preferably, the blocking of the lower sash in the horizontal open and closed window positions takes place coincidentally with the descent and ascent of the inner rod on the blocking slider and in a simple manner. Thus, use is made of a blocking pin connected to the lower end of a guide strip secured to the inner rod, which pin runs between the ends of a slanted channel laid out in one of the faces of said blocking slider also provided with an insertion projection in a retention clip that is used to keep the scissor mechanisms stretched once folded.

Advantageously, a closure guide with a "V"-shaped channel for sliding the opposite end of the blocking pin, is laid out in each window frame jamb in such a way that one of its branches faces the slanted channel of the blocking slider to define a common channel for the advance of the pin in its forced descent in the scissor mechanism opening until abutting against the lower end of the slanted channel of the blocking slider, coincidentally with the complete opening of the scissor mechanism, and yet to allow its escape through the contiguous branch of the V-shaped channel that is vertically oriented, thus defining a guideway that is continued in the corresponding guide rod laid out in each side jamb of the window frame in order to enable the vertical movement of the lower window sash. In this way it is achieved that the lower window sash, projected out of, or extracted from, the closure plane or closure first vertical plane, emerges from the retention clip, thus initiating its ascent, during which the pin is guided by the vertical branch of the sliding "V"-shaped channel, thus preventing the scissor mechanism from closing and problems from occurring with the upper sash.

Additionally, unlike similar mechanisms, the counterweight vertical-movement mechanism preferably comprises a hexagonal-section shaft, a positioner, a multi-point brake, a counter-balanced spring or torsion spring, and two grooved pulleys with their respective cables. The positioner is designed with ball elements or a similar arrangement that act perpendicularly on the hexagonal bar, thus establishing various rotating positions. The multi-point brake is intended to control the braking force so as to increase or decrease the ascending force exerted by the counterbalanced spring on the lower sash in its vertical movement. This brake makes it possible to use a single spring for multiple different sizes of windows, thus avoiding the current problems of systems with springs and counterweights, in which the spring varies depending on the size and weight of the sash. The pulleys and cables transmit the effort to the lower window sash, for which reason die-cast pulleys and steel cables are preferred. The counter-balanced spring is secured to the shaft by means of grooved pieces. The entire assembly is mounted onto a "U"-shaped aluminum profile, so that the pieces are introduced into it, as in a guide rail. A standard cremone bolt with two fastening points in the lower part and two fastening points in the sides using one return means each constitutes the fastening for the sash in the window frame.

One advantage of the invention is that the window may incorporate perimetral sealing gaskets in the front part of the window frame. Furthermore, the type of fastening used and the cremone bolt ensure a strong sealing comparable to that of a tilt-and-turn or operable window.

Another advantage of the present invention is that the manufacture, the assembly of all its components, and the use of the scissor mechanisms that constitute the means of projection of the window sash, are easily achieved.

BRIEF DESCRIPTION OF THE DRAWINGS

These and other advantages are achievable by the present invention, as shall be seen from the following description of one of its embodiments that must be considered solely as an example by way of illustration and not of limitation, in combination with the drawings, wherein.

DETAILED DESCRIPTION OF THE INVENTION

Figure 1:
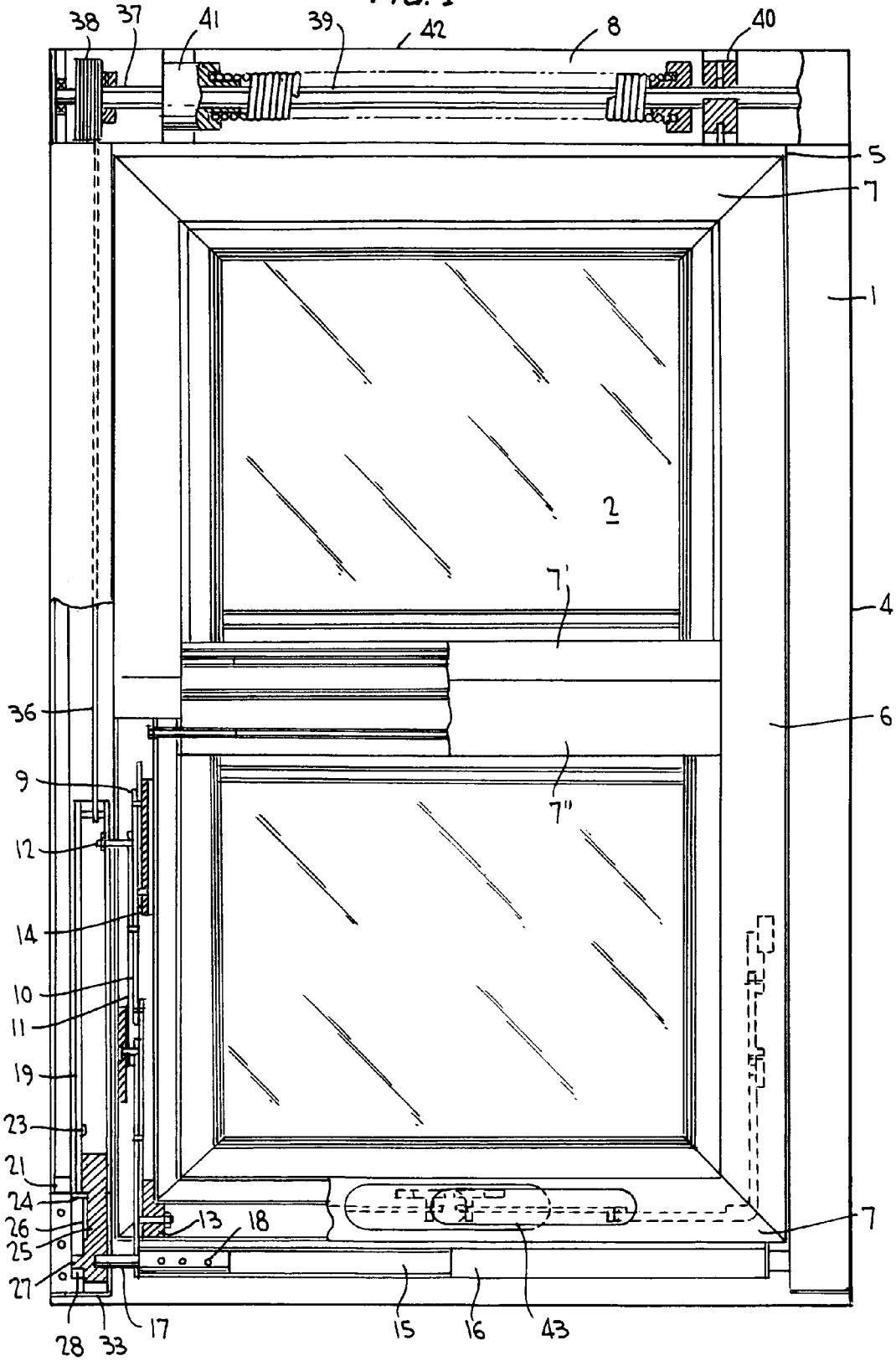
FIG. 1 shows a front schematic view of a sash window, represented in the closed window position, with its sashes arranged in a single vertical plane to close the opening of the window frame. Its interior configuration is shown by means of dashed lines and partial sectioning.
Figure 2:
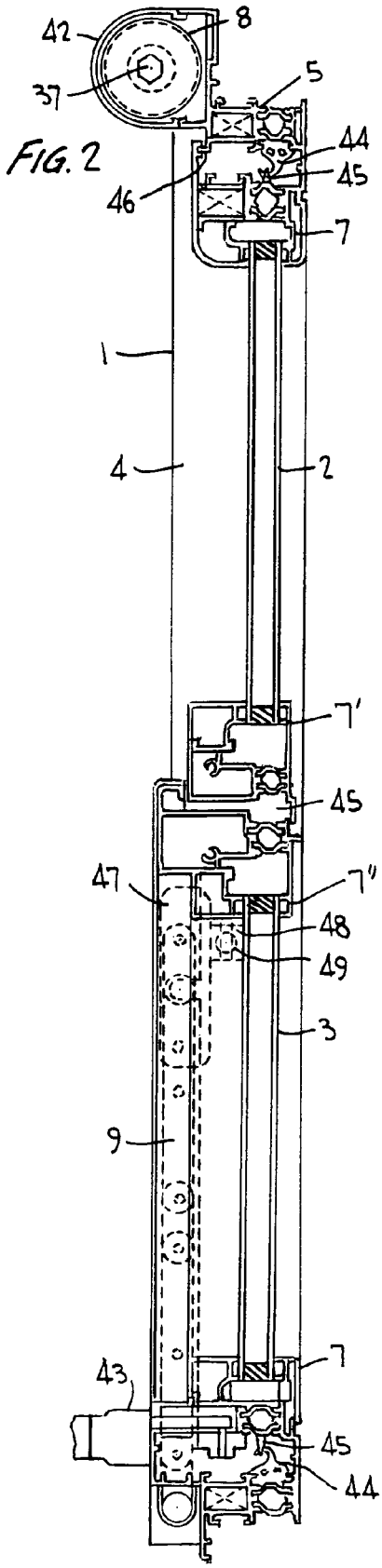
FIG. 2 shows, in correspondence with the front view represented in FIG. 1, a longitudinally sectional side view of the window.

According to the proposed embodiment that may be observed in the various figures of the drawings, an improved sash window according to the invention includes a window frame (1) and two window sashes, an upper one (2) and a lower one (3) one, that are arranged in the window frame (1) occupying the same first vertical plane in the closed window position, as best seen in FIGS. 1 and 2, preferably in FIG. 2. The window frame (1) presents side jambs (4) joined at the top to a horizontal crosshead (5). The window sashes (2) and (3) incorporate side stiles (6) and horizontal rails (7, 7' and 7").

The lower sash (3) is best seen in FIG. 1, connected by means of cables (36) to a counterweight vertical-movement mechanism (8) that includes a counterbalanced spring (39).

The window incorporates scissor mechanisms (9) that act as projection means so as to horizontally and frontally move said lower sash (3) from the first vertical plane in the closed position to a second vertical plane in a separate open position, or vice versa. As can be better understood from the figures, preferably FIGS. 2 and 4, the scissor mechanisms are guided between both jambs (4) of the window frame (1).

Figure 4:
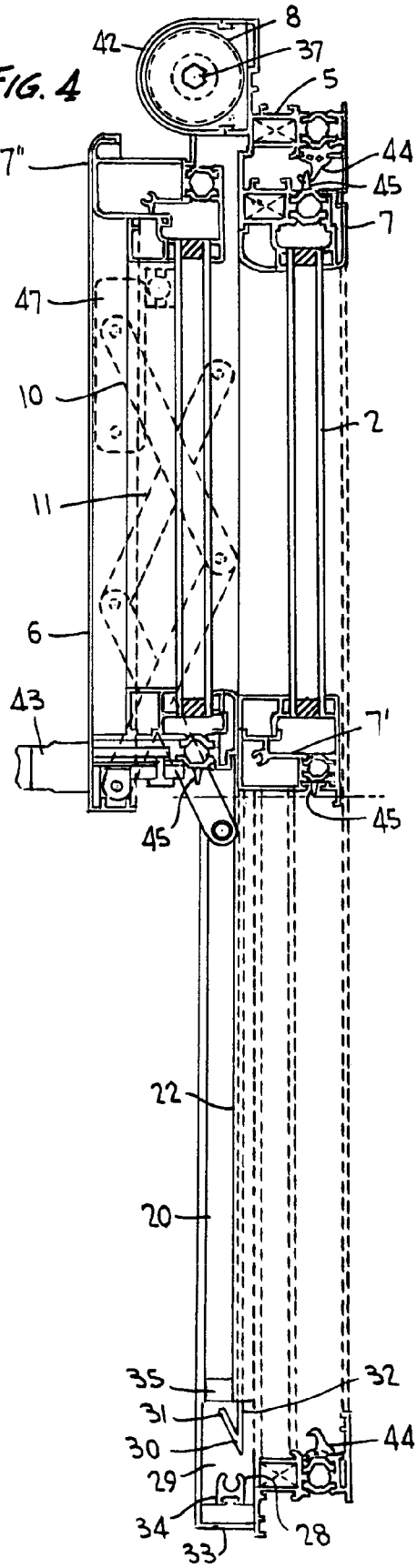
FIG. 4 shows a side view of the window like the one represented in FIG. 2, but with the same lower sash shown raised and in a final open window position.

As can be better seen from FIG. 4, each of the scissor mechanisms (9) is formed by two arms, (10) and (11), formed by hinged strips and articulated to each other. The first arm (10) presents a lower end that is articulated to the square anchor (13) disposed in the proximity of the immediate bottom corner of the lower window sash (3) and an upper end that can be viewed as articulated to the anchor (14), formed in the example by an anchor strip (14), that is guided in the immediate stile (6) of the lower window sash (3). The second arm (11) incorporates, in its upper end, the pin (12) that traverses the outer facing of the immediate stile (6), and is secured to the inner rod (19) that is housed in the guide rod (20) secured to the immediate jamb (4) of the window frame (1), while the lower ends of the second arms (11) are secured to the ends of the torsion bar (15) formed by the hollow tube (16) that maintains the separation of the arms (11) and to the ends of which the terminals (17) are axially joined by means of elastic pins (18), that locks together the movements of the scissor mechanisms (9) situated to the right and left between the stiles (6) of the lower sash (3) to be projected and the respective jambs (4) of the window frame (1), and that is connected by its ends to the respective blocking sliders (25) that, on each jamb (4), guide the scissor mechanisms (9) in their movements.

In the example, the closure guide (23) is formed by an oblong body, secured vertically at the bottom end of each jamb (4) of the window frame (1), with a flat lateral surface in which there has been provided a "V"-shaped guide channel (30) with one branch each, a slanted one (31) and a vertical one (32), for the blocking pin (24); at the top, it presents a parallelepipedic narrowing (35) adjusted to a housing (21) in the guide rod (20).

Adjacent to the housing (21), although open toward the inner rod (19), there can be seen a guide groove (22) that is a continuation of the vertical branch (32) in the guiding of the blocking pin (24) during sliding of the lower window sash (3). In the proximate of the lower base of the closure guide (23), there is shown an anchoring appendage (34) for the retention clip (28). A cap (33) coupled to the closure guide (23) closes each jamb (4) from below.

According to the proposed example, the counterweight vertical-movement mechanism (8) includes a hexagonal-section shaft (37) into which there have been threaded the positioner (40), the multi-points brake (41), the counterbalanced spring (39) and two grooved pulleys (38) with their respective cables (36). The assembly can be seen disposed in a box profile (42). A standard cremone bolt (43), with two fastening points in the lower part and two fastening points in the sides using one return means each, contributes to the sealing of the entire assembly. According to the example, the profiled sealing gaskets (44), (45), and (46) cooperate therewith.

Figure 3:
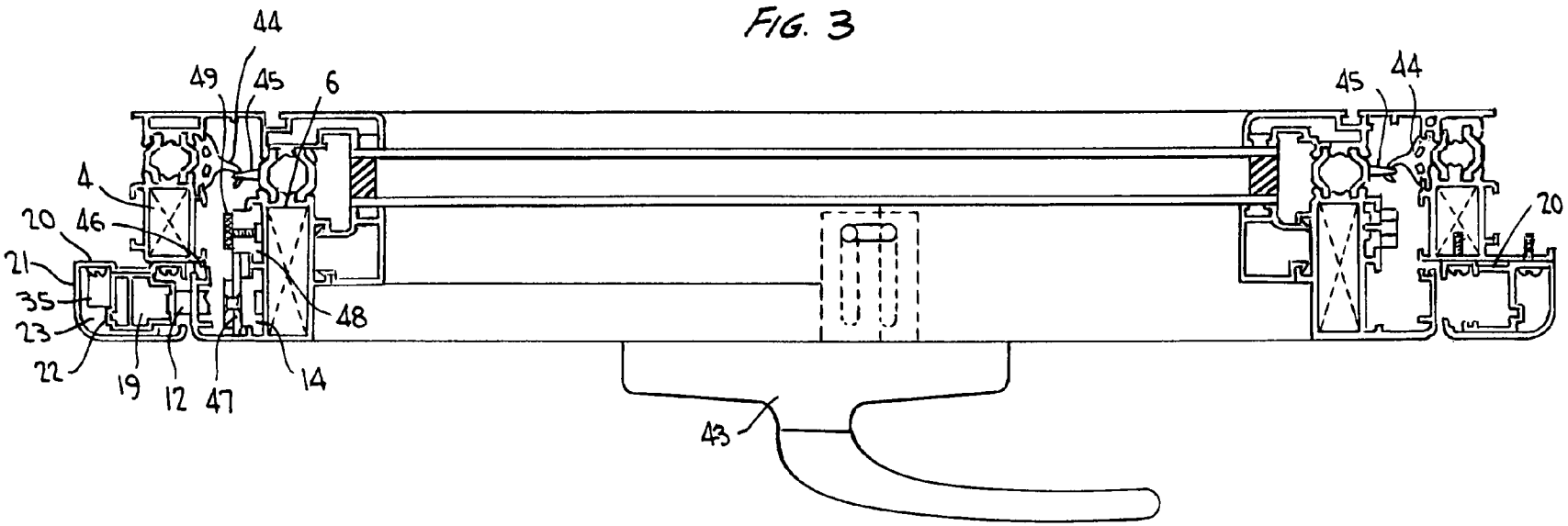
FIG. 3 shows, in correspondence with the preceding figures, a cross-sectional view from underneath the top rail of the lower window sash, which makes it possible to understand the configuration of the window elements, and, among other things, the layout of a sash lowering mechanism.

For the purpose of outside cleaning of the window, and as better shown in FIG. 3, a lowering system has been incorporated into the sash, which lowering system includes the plate (47) that remains affixed to the upper sliding part in each scissor mechanism (9) by means of the sliding strip (48) that is secured by means of a knurled-head screw (49) that presses against the sash. Loosening the screw (49) will enable the strip (48) to move, thus permitting the rotation of the piece (47).

Figure 5:
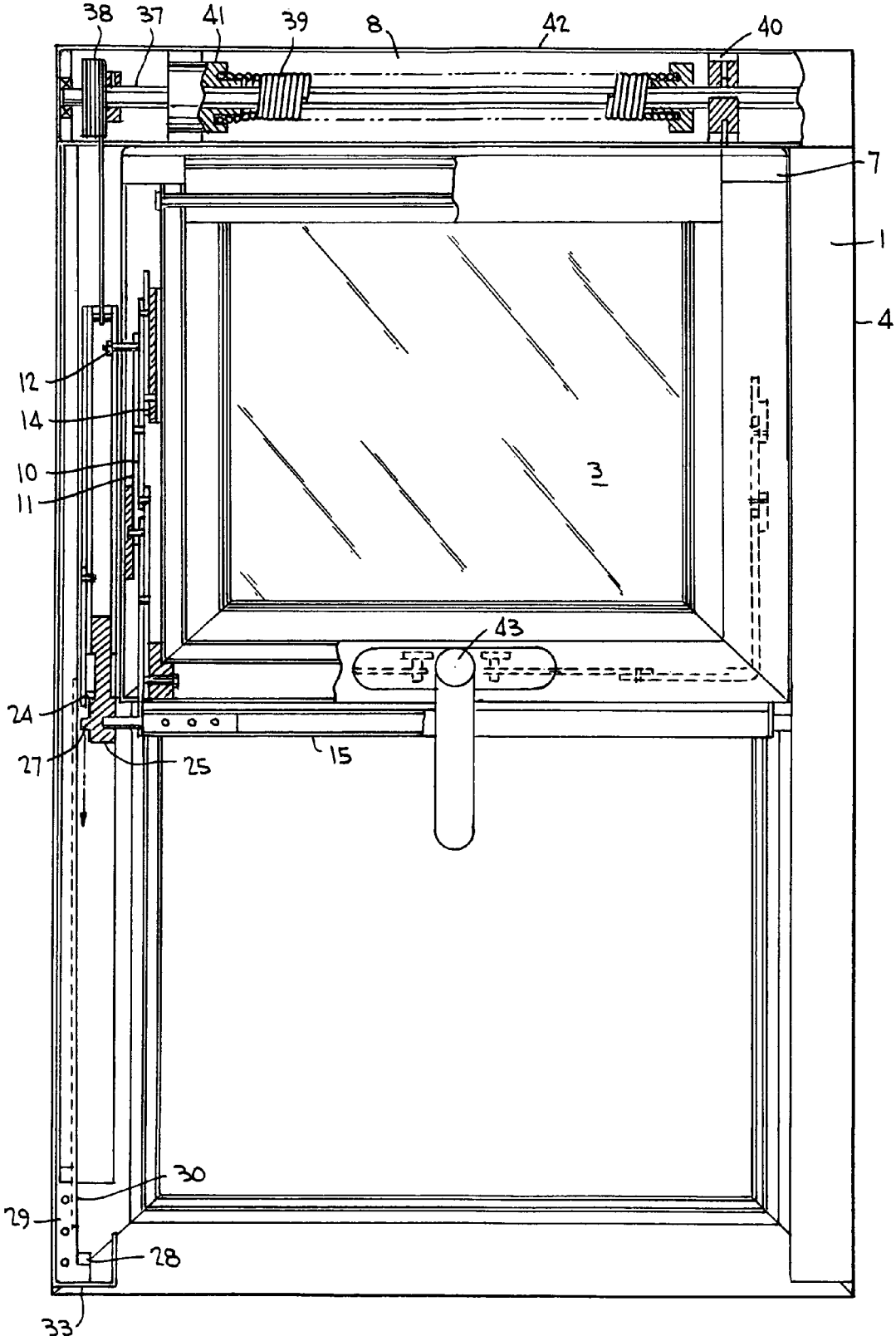
FIG. 5 shows a front view of the window like the one represented in FIG. 1, but with the same lower sash shown elevated and in a final open window position.

Starting from the closed window position shown in FIGS. 1 and 2, it becomes clear that the lower window sash being freed, once the user has activated the cremone bolt (43) and as a result of the traction that the user exerts toward him/herself on the lower window sash (3), the scissor mechanisms (9) become open, thus establishing a major horizontal separation between the ends of the arms (10) and (11) and triggering the descent of the pin (12), which forces the inner rod (19) to descend in the guide rod (20), the descent of the closure strip (24), and forces the pin (24) articulated at its end to slide downward in the slanted channel (26) of the blocking slider (25) and to end its path by abutting against the lower end thereof, which coincides with the total extraction of the sash, this position becoming set once the elevation movement is initiated. Concurrently with the sliding, the opposite end of the pin (24) slides in the slanted channel (31) of the closure guide (23) until coming to the lower position thereon at the confluence with the vertical channel (32) to which it is forced to accede, with the user's force and the aid of the counterweight vertical-movement mechanism (8), so as to continue its guided ascent in the vertical groove (22) present in the guide rod (20), thus pulling in its ascent the blocking slider (25) that has previously been separated from the retention clip (28) and that forces the torsion bar (15) and the elevation of the scissor mechanisms (9) that carry with them the lower window sash (3) so as to move it to the position required by the user, for example, until a final open position such as that shown in FIGS. 4 and 5.

From any intermediate position or from this final open window arrangement, the user need only exert a slight downward traction, aided by the counterweight vertical-movement mechanism (8), in order to force the lower window sash (3) to descend until the lowest position in its path in said second vertical plane, and thus come to face the hollow that it must occupy in the first vertical plane in order to attempt the closing of the window, which is achieved by keeping the scissor mechanisms (9) open. The user need only push against the hollow the lower window sash (3) to make the scissor mechanisms (9) fold in the reverse direction to the fold when open, thus forcing the raising of their arms, the ascent of the inner rod (19) in the guide rod (20) and the ascent of the closure strip (24), and forcing the pin (24) articulated at its end to abandon the vertical groove (22) in the guide rod (20) and to descend in the vertical channel (32) of the closure guide (23) so as, the confluence between the two being saved, to return to the slanted channel (31) converging therein and to ensure the retention of the blocking slider (25) in said lower position, maintaining the opposite end of the pin (24) in the highest position of the slanted channel (26) of the blocking slider (25) and attempting additionally the entry of the projection (27) into the retention clip (28) that will keep the scissor mechanisms (9) stretched in the closed position.

The counterweight vertical-movement mechanism (8) is counterbalanced in order to maintain a slight tension on the blocking slider (25), which tension does not reach that required to free the projection (27) from the blocking slider (25) of the retention clip (28).

The invention claimed is:

1. A sash window comprising a window frame; at least two window sashes, including an upper sash and a lower sash, disposed in the window frame and occupying a common first vertical plane in a closed window position, the lower sash being connected by cables to a counterweight vertical-movement mechanism constructed to enable the lower sash to move vertically in the window frame, in parallel arrangement to the upper sash and in an open window position; two scissor mechanisms that are guided between jambs of the window frame so as to horizontally and frontally project said lower sash from the first vertical plane in the closed window position to a second vertical plane in the open window position, or vice versa, wherein each of said two scissor mechanisms includes a first arm and a second arm, with each of said first arm and said second arm being formed by two strips hingedly connected and said first arm and said second arm being articulated with respect to each other so as to pivot in opposite directions and whose arrangement in the window frame determines a single degree of freedom for the lower sash to project the lower sash frontally and horizontally outward in the window frame; and blocking elements to maintain said lower sash in said open window position, said blocking elements comprising a blocking slider, and wherein the lower sash is moved in a vertical path by said counterweight vertical-movement mechanism.

2. The sash window as claimed in claim 1, wherein said first arm in each of said two scissor mechanisms have a lower end connected by hinged means to a first anchor arranged near a respective bottom corner of the lower sash while an upper end of a respective one of said two scissor mechanisms is connected to a second anchor guided in a respective stile of the lower sash, and said second arm in each of said two scissor mechanisms, whose upper end includes a pin that traverses an outer facing of a respective stile and is connected to an inner rod that runs through a guide rod secured to a nearby jamb of the window frame, while a lower end of said second arm is secured to one side of a torsion bar connected at ends thereof to blocking sliders structured to guide movement of said second arm in a respective jamb.

3. The sash window as claimed in claim 2, wherein blocking and unblocking of the lower sash in the open window position and the closed window position occurs in conjunction with descent and ascent of the inner rod on one of the blocking sliders and by a blocking pin connected to a lower end of a guide strip anchored to the inner rod that runs between ends of a slanted channel provided in one face of said blocking slider, which presents underneath an insertion projection in a retention clip provided underneath in a closure guide that provides a "V"-shaped guide channel having a slanted branch and a vertical branch, cooperates with the blocking pin to block the lower sash in the window frame in the closed window position and, successively, directs movement thereof in a guide groove in the guide rod in each jamb of the window frame.

* * * * *